US011794075B2

(12) United States Patent
Watterson et al.

(10) Patent No.: US 11,794,075 B2
(45) Date of Patent: Oct. 24, 2023

(54) STATIONARY EXERCISE MACHINE CONFIGURED TO EXECUTE A PROGRAMMED WORKOUT WITH AEROBIC PORTIONS AND LIFTING PORTIONS

(71) Applicant: iFIT Inc., Logan, UT (US)

(72) Inventors: Scott R. Watterson, Providence, UT (US); William T. Dalebout, North Logan, UT (US)

(73) Assignee: iFIT Inc., Logan, UT (US)

( * ) Notice: Subject to any disclaimer, the term of this patent is extended or adjusted under 35 U.S.C. 154(b) by 213 days.

(21) Appl. No.: 17/323,131

(22) Filed: May 18, 2021

(65) Prior Publication Data

US 2021/0268336 A1 Sep. 2, 2021

Related U.S. Application Data

(63) Continuation of application No. 17/115,690, filed on Dec. 8, 2020, now Pat. No. 11,013,960, which is a (Continued)

(51) Int. Cl.
*A63B 24/00* (2006.01)
*A63B 71/00* (2006.01)
(Continued)

(52) U.S. Cl.
CPC ..... *A63B 24/0087* (2013.01); *A63B 21/072* (2013.01); *A63B 21/075* (2013.01);
(Continued)

(58) Field of Classification Search
CPC ..... A63B 24/0087; A63B 71/0036; A63B 21/072; A63B 22/0242; A63B 21/0726;
(Continued)

(56) References Cited

U.S. PATENT DOCUMENTS 3,123,646 A 3/1964 Easton
3,579,339 A 5/1971 Chang et al.
(Continued)

FOREIGN PATENT DOCUMENTS

KR 100829774 5/2018

OTHER PUBLICATIONS

U.S. Appl. No. 62/310,503, filed Mar. 18, 2016, titled "Coorrdinated Weight Selection".
(Continued)

*Primary Examiner* — Sundhara M Ganesan
(74) *Attorney, Agent, or Firm* — RAY QUINNEY & NEBEKER P.C.; Paul N. Taylor

(57) ABSTRACT

Stationary exercise machine configured to execute a programmed workout with aerobic portions and lifting portions. In one embodiment, a stationary exercise machine may include an aerobic exercise element configured to be movable during execution of a programmed workout, a display, one or more processors, and memory. The memory may be configured to store programmed instructions of the programmed workout that, when executed by the one or more processors, cause the one or more processors to: automatically alternate, by the programmed instructions of the programmed workout, between aerobic portions and lifting portions, automatically control, by the programmed instructions of the programmed workout, a speed, or a resistance level, of the aerobic exercise element during the aerobic portions, automatically present, by the programmed instructions of the programmed workout, lifting instructions on the display, the lifting instructions configured to instruct a user on lifting one or more free weights during the lifting portions.

20 Claims, 7 Drawing Sheets

Related U.S. Application Data continuation of application No. 16/299,668, filed on Mar. 12, 2019, now Pat. No. 10,864,407, which is a continuation of application No. 15/461,040, filed on Mar. 16, 2017, now Pat. No. 10,293,211.

(60) Provisional application No. 62/310,503, filed on Mar. 18, 2016.

(51) Int. Cl.

| | |
|---|---|
| ***A63B 22/02*** | (2006.01) |
| ***A63B 22/06*** | (2006.01) |
| ***A63B 21/075*** | (2006.01) |
| ***A63B 22/00*** | (2006.01) |
| ***A63B 69/00*** | (2006.01) |
| ***A63B 21/072*** | (2006.01) |
| ***A63B 71/06*** | (2006.01) |

(52) U.S. Cl.

CPC ..... *A63B 21/0726* (2013.01); *A63B 22/0242* (2013.01); *A63B 22/0605* (2013.01); *A63B 24/0062* (2013.01); *A63B 24/0075* (2013.01); *A63B 69/0057* (2013.01); *A63B 71/0036* (2013.01); *A63B 71/0622* (2013.01); *A63B 71/0686* (2013.01); *A63B 21/0724* (2013.01); *A63B 22/0023* (2013.01); *A63B 22/0048* (2013.01); *A63B 22/0076* (2013.01); *A63B 22/02* (2013.01); *A63B 22/0664* (2013.01); *A63B 2024/0093* (2013.01); *A63B 2071/063* (2013.01); *A63B 2071/065* (2013.01); *A63B 2071/0625* (2013.01); *A63B 2220/17* (2013.01); *A63B 2220/20* (2013.01); *A63B 2220/30* (2013.01); *A63B 2220/51* (2013.01); *A63B 2220/58* (2013.01); *A63B 2220/805* (2013.01); *A63B 2220/807* (2013.01); *A63B 2225/20* (2013.01); *A63B 2225/50* (2013.01); *A63B 2225/68* (2013.01); *A63B 2225/74* (2020.08); *A63B 2230/01* (2013.01); *A63B 2230/06* (2013.01); *A63B 2230/062* (2013.01)

(58) Field of Classification Search

CPC ... A63B 21/075; A63B 22/02; A63B 24/0062; A63B 24/0075; A63B 71/0622; A63B 71/0686; A63B 2220/51; A63B 21/0724; A63B 69/0057; A63B 2220/20; A63B 22/0048; A63B 22/0076; A63B 2024/0093; A63B 2071/063; A63B 2071/065; A63B 22/0023; A63B 2230/01; A63B 2225/20; A63B 2220/807; A63B 2220/58; A63B 2225/68; A63B 2225/50; A63B 2220/30; A63B 2220/805; A63B 2230/062; A63B 22/0605; A63B 2207/02; A63B 22/0664; A63B 2230/06; A63B 2220/17; A63B 2071/0625; A63B 2225/74

See application file for complete search history.

(56) References Cited

U.S. PATENT DOCUMENTS

| | | | |
|---|---|---|---|
| 4,023,795 | A | 5/1977 | Pauls |
| 4,300,760 | A | 11/1981 | Bobroff |
| 4,413,821 | A | 11/1983 | Centafanti |
| D286,311 | S | 10/1986 | Martinell et al. |
| 4,681,318 | A | 7/1987 | Lay |
| 4,684,126 | A | 8/1987 | Dalebout et al. |
| 4,705,028 | A | 11/1987 | Melby |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,830,371 | A | 5/1989 | Lay |
| 4,844,451 | A | 7/1989 | Bersonnet et al. |
| 4,850,585 | A | 7/1989 | Dalebout |
| D304,849 | S | 11/1989 | Watterson |
| 4,880,225 | A | 11/1989 | Lucas et al. |
| 4,883,272 | A | 11/1989 | Lay |
| D306,468 | S | 3/1990 | Watterson |
| D306,891 | S | 3/1990 | Watterson |
| 4,913,396 | A | 4/1990 | Dalebout et al. |
| D307,614 | S | 5/1990 | Bingham et al. |
| D307,615 | S | 5/1990 | Bingham et al. |
| 4,921,242 | A | 5/1990 | Watterson |
| 4,932,650 | A | 6/1990 | Bingham et al. |
| D309,167 | S | 7/1990 | Griffin |
| D309,485 | S | 7/1990 | Bingham et al. |
| 4,938,478 | A | 7/1990 | Lay |
| D310,253 | S | 8/1990 | Bersonnet et al. |
| 4,955,599 | A | 9/1990 | Bersonnet et al. |
| 4,971,316 | A | 11/1990 | Dalebout et al. |
| D313,055 | S | 12/1990 | Watterson |
| 4,974,832 | A | 12/1990 | Dalebout |
| 4,979,737 | A | 12/1990 | Kock |
| 4,981,294 | A | 1/1991 | Dalebout et al. |
| D315,765 | S | 3/1991 | Measom et al. |
| 4,998,725 | A | 3/1991 | Watterson et al. |
| 5,000,442 | A | 3/1991 | Dalebout et al. |
| 5,000,443 | A | 3/1991 | Dalebout et al. |
| 5,000,444 | A | 3/1991 | Dalebout et al. |
| D316,124 | S | 4/1991 | Dalebout et al. |
| 5,013,033 | A | 5/1991 | Watterson et al. |
| 5,014,980 | A | 5/1991 | Bersonnet et al. |
| 5,016,871 | A | 5/1991 | Dalebout et al. |
| D318,085 | S | 7/1991 | Jacobson et al. |
| D318,086 | S | 7/1991 | Bingham et al. |
| D318,699 | S | 7/1991 | Jacobson et al. |
| 5,029,801 | A | 7/1991 | Dalebout et al. |
| 5,034,576 | A | 7/1991 | Dalebout et al. |
| 5,058,881 | A | 10/1991 | Measom |
| 5,058,882 | A | 10/1991 | Dalebout et al. |
| D321,388 | S | 11/1991 | Dalebout |
| 5,062,626 | A | 11/1991 | Dalebout et al. |
| 5,062,627 | A | 11/1991 | Bingham |
| 5,062,632 | A | 11/1991 | Dalebout et al. |
| 5,062,633 | A | 11/1991 | Engel et al. |
| 5,067,710 | A | 11/1991 | Watterson et al. |
| 5,072,929 | A | 12/1991 | Peterson et al. |
| D323,009 | S | 1/1992 | Dalebout et al. |
| D323,198 | S | 1/1992 | Dalebout et al. |
| D323,199 | S | 1/1992 | Dalebout et al. |
| D323,863 | S | 2/1992 | Watterson |
| 5,088,729 | A | 2/1992 | Dalebout |
| 5,090,694 | A | 2/1992 | Pauls et al. |
| 5,102,380 | A | 4/1992 | Jacobson et al. |
| 5,104,120 | A | 4/1992 | Watterson et al. |
| 5,108,093 | A | 4/1992 | Watterson |
| D326,491 | S | 5/1992 | Dalebout |
| 5,122,105 | A | 6/1992 | Engel et al. |
| 5,135,216 | A | 8/1992 | Bingham et al. |
| 5,135,458 | A | 8/1992 | Huang |
| 5,147,265 | A | 9/1992 | Pauls et al. |
| 5,149,084 | A | 9/1992 | Dalebout et al. |
| 5,149,312 | A | 9/1992 | Croft et al. |
| 5,158,520 | A | 10/1992 | Lemke |
| 5,171,196 | A | 12/1992 | Lynch |
| D332,347 | S | 1/1993 | Raadt et al. |
| 5,190,505 | A | 3/1993 | Dalebout et al. |
| 5,192,255 | A | 3/1993 | Dalebout et al. |
| 5,195,937 | A | 3/1993 | Engel et al. |
| 5,203,826 | A | 4/1993 | Dalebout |
| D335,511 | S | 5/1993 | Engel et al. |
| D335,905 | S | 5/1993 | Cutter et al. |
| D336,498 | S | 6/1993 | Engel et al. |
| 5,217,487 | A | 6/1993 | Engel et al. |
| D337,361 | S | 7/1993 | Engel et al. |
| D337,666 | S | 7/1993 | Peterson et al. |
| D337,799 | S | 7/1993 | Cutter et al. |

(56) References Cited

U.S. PATENT DOCUMENTS 5,226,866 A 7/1993 Engel et al.
5,242,339 A 9/1993 Thornton
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,385,520 A 1/1995 Lepine
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,540 A 5/1997 Hall
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,667,461 A 9/1997 Hall
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
5,921,892 A 7/1999 Easton
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,113,519 A 9/2000 Goto
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,506,142 B2 1/2003 Itoh
6,527,678 B1 3/2003 Wang
6,547,698 B2 4/2003 Inagawa
6,563,225 B2 5/2003 Soga et al.
6,601,016 B1 7/2003 Brown et al.
6,623,140 B2 9/2003 Watterson et al.
6,626,799 B2 9/2003 Watterson
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,719,667 B2 4/2004 Wong
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson

(56) References Cited

U.S. PATENT DOCUMENTS 6,783,482 B2 8/2004 Oglesby
6,786,852 B2 9/2004 Watterson et al.
6,796,925 B2 9/2004 Martinez
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
6,878,101 B2 4/2005 Colley
D507,311 S 7/2005 Butler et al.
6,918,858 B2 7/2005 Watterson
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,070,542 B2 7/2006 Reyes
7,097,588 B2 8/2006 Watterson et al.
D527,776 S 9/2006 Willardson et al.
7,112,168 B2 9/2006 Dalebout et al.
7,125,369 B2 10/2006 Endelman
7,128,693 B2 10/2006 Brown et al.
7,132,939 B2 11/2006 Tyndall
7,153,240 B1 12/2006 Wu
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,172,536 B2 2/2007 Liu
7,192,387 B2 3/2007 Mendel
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,452,311 B2 11/2008 Barnes
7,455,622 B2 11/2008 Watterson et al.
7,470,219 B2 12/2008 Larson
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,578,771 B1 8/2009 Towley, III et al.
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,320 B2 8/2010 Riley
7,771,329 B2 8/2010 Dalebout
7,775,940 B2 8/2010 Dalebout et al.
7,789,800 B1 9/2010 Watterson et al.
7,798,946 B2 9/2010 Dalebout et al.
7,806,589 B2 10/2010 Tashman
7,815,548 B2 10/2010 Barre
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
7,862,489 B2 1/2011 Savsek
7,887,470 B2 2/2011 Chen
D635,207 S 3/2011 Dalebout et al.
7,901,324 B2 3/2011 Kodama
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,007,409 B2 8/2011 Ellis
8,029,415 B2 10/2011 Ashby et al.
8,033,960 B1 10/2011 Dalebout et al.
D650,451 S 12/2011 Olson et al.
8,075,453 B1 12/2011 Wilkinson
D652,877 S 1/2012 Dalebout et al.
8,152,702 B2 4/2012 Pacheco
8,157,708 B2 4/2012 Daly
D659,775 S 5/2012 Olson et al.
D659,777 S 5/2012 Watterson et al.
D660,383 S 5/2012 Watterson et al.
D664,613 S 7/2012 Dalebout et al.
8,251,874 B2 8/2012 Ashby et al.
8,257,232 B2 9/2012 Albert
8,298,123 B2 10/2012 Hickman
8,298,125 B2 10/2012 Colledge et al.
D671,177 S 11/2012 Sip
D671,178 S 11/2012 Sip
8,308,618 B2 11/2012 Bayerlein
D673,626 S 1/2013 Olson et al.
8,608,624 B2 12/2013 Shabodyash
8,690,735 B2 4/2014 Watterson et al.
D707,763 S 6/2014 Cutler
8,740,753 B2 6/2014 Olson et al.
8,747,285 B2 6/2014 Hof
8,758,201 B2 6/2014 Ashby et al.
8,771,153 B2 7/2014 Dalebout et al.
8,784,270 B2 7/2014 Ashby et al.
8,784,275 B2 7/2014 Mikan
8,784,278 B2 7/2014 Flake
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,911,330 B2 12/2014 Watterson et al.
8,920,288 B2 12/2014 Dalebout et al.
8,920,347 B2 12/2014 Bayerlein
8,979,709 B2 3/2015 Toback
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,072,930 B2 7/2015 Ashby et al.

(56) References Cited

U.S. PATENT DOCUMENTS

| | | | |
|---|---|---|---|
| 9,119,983 | B2 | 9/2015 | Rhea |
| 9,119,988 | B2 | 9/2015 | Murray |
| 9,123,317 | B2 | 9/2015 | Watterson et al. |
| 9,126,071 | B2 | 9/2015 | Smith |
| 9,126,072 | B2 | 9/2015 | Watterson |
| 9,138,615 | B2 | 9/2015 | Olson et al. |
| 9,142,139 | B2 | 9/2015 | Watterson et al. |
| 9,144,703 | B2 | 9/2015 | Dalebout et al. |
| 9,149,683 | B2 | 10/2015 | Watterson et al. |
| 9,186,535 | B2 | 11/2015 | Ercanbrack |
| 9,186,549 | B2 | 11/2015 | Watterson et al. |
| 9,186,552 | B1 | 11/2015 | Deal |
| 9,227,101 | B2 | 1/2016 | Maguire |
| 9,233,272 | B2 | 1/2016 | Villani |
| 9,254,409 | B2 | 2/2016 | Dalebout et al. |
| 9,254,416 | B2 | 2/2016 | Ashby |
| 9,278,248 | B2 | 3/2016 | Tyger et al. |
| 9,278,249 | B2 | 3/2016 | Watterson |
| 9,278,250 | B2 | 3/2016 | Buchanan |
| 9,289,648 | B2 | 3/2016 | Watterson |
| 9,292,935 | B2 | 3/2016 | Koduri et al. |
| 9,308,417 | B2 | 4/2016 | Grundy |
| 9,339,683 | B2 | 5/2016 | Dilli |
| 9,339,691 | B2 | 5/2016 | Brammer |
| 9,352,185 | B2 | 5/2016 | Hendrickson et al. |
| 9,352,186 | B2 | 5/2016 | Watterson |
| 9,364,714 | B2 | 6/2016 | Koduri et al. |
| 9,375,605 | B2 | 6/2016 | Tyger et al. |
| 9,378,336 | B2 | 6/2016 | Ohnemus |
| 9,381,394 | B2 | 7/2016 | Mortensen et al. |
| 9,387,387 | B2 | 7/2016 | Dalebout |
| 9,393,453 | B2 | 7/2016 | Watterson |
| 9,403,047 | B2 | 8/2016 | Olson et al. |
| 9,403,051 | B2 | 8/2016 | Cutler |
| 9,421,416 | B2 | 8/2016 | Mortensen et al. |
| 9,457,219 | B2 | 10/2016 | Smith |
| 9,457,220 | B2 | 10/2016 | Olson |
| 9,457,222 | B2 | 10/2016 | Dalebout |
| 9,460,632 | B2 | 10/2016 | Watterson |
| 9,463,356 | B2 | 10/2016 | Rhea |
| 9,468,794 | B2 | 10/2016 | Barton |
| 9,468,798 | B2 | 10/2016 | Dalebout |
| 9,480,874 | B2 | 11/2016 | Cutler |
| 9,492,704 | B2 | 11/2016 | Mortensen et al. |
| 9,498,668 | B2 | 11/2016 | Smith |
| 9,517,378 | B2 | 12/2016 | Ashby et al. |
| 9,521,901 | B2 | 12/2016 | Dalebout |
| 9,533,187 | B2 | 1/2017 | Dalebout |
| 9,539,461 | B2 | 1/2017 | Ercanbrack |
| 9,550,091 | B2 | 1/2017 | Emerson |
| 9,579,544 | B2 | 2/2017 | Watterson |
| 9,586,086 | B2 | 3/2017 | Dalebout et al. |
| 9,586,090 | B2 | 3/2017 | Watterson et al. |
| 9,604,099 | B2 | 3/2017 | Taylor |
| 9,616,276 | B2 | 4/2017 | Dalebout et al. |
| 9,616,278 | B2 | 4/2017 | Olson |
| 9,623,281 | B2 | 4/2017 | Hendrickson et al. |
| 9,636,567 | B2 | 5/2017 | Brammer et al. |
| 9,675,839 | B2 | 6/2017 | Dalebout et al. |
| 9,682,307 | B2 | 6/2017 | Dalebout |
| 9,694,234 | B2 | 7/2017 | Dalebout et al. |
| 9,694,242 | B2 | 7/2017 | Ashby et al. |
| 9,737,755 | B2 | 8/2017 | Dalebout |
| 9,750,454 | B2 | 9/2017 | Walke |
| 9,757,605 | B2 | 9/2017 | Olson et al. |
| 9,764,186 | B2 | 9/2017 | Dalebout et al. |
| 9,767,785 | B2 | 9/2017 | Ashby et al. |
| 9,776,032 | B2 | 10/2017 | Moran |
| 9,795,822 | B2 | 10/2017 | Smith et al. |
| 9,795,855 | B2 | 10/2017 | Jafarifesharaki |
| 9,808,672 | B2 | 11/2017 | Dalebout |
| 9,849,326 | B2 | 12/2017 | Smith |
| 9,878,210 | B2 | 1/2018 | Watterson |
| 9,889,334 | B2 | 2/2018 | Ashby et al. |
| 9,889,339 | B2 | 2/2018 | Douglass |
| 9,919,183 | B1 | 3/2018 | Moschel |
| 9,937,376 | B2 | 4/2018 | McInelly et al. |
| 9,937,377 | B2 | 4/2018 | McInelly et al. |
| 9,937,378 | B2 | 4/2018 | Dalebout et al. |
| 9,937,379 | B2 | 4/2018 | Mortensen et al. |
| 9,943,719 | B2 | 4/2018 | Smith et al. |
| 9,943,722 | B2 | 4/2018 | Dalebout |
| 9,948,037 | B2 | 4/2018 | Ashby |
| 9,968,816 | B2 | 5/2018 | Olson et al. |
| 9,968,821 | B2 | 5/2018 | Finlayson et al. |
| 9,968,823 | B2 | 5/2018 | Cutler |
| 9,980,465 | B2 | 5/2018 | Hayashi |
| 10,010,755 | B2 | 7/2018 | Watterson |
| 10,010,756 | B2 | 7/2018 | Watterson |
| 10,029,145 | B2 | 7/2018 | Douglass |
| D826,350 | S | 8/2018 | Hochstrasser |
| 10,046,196 | B2 | 8/2018 | Ercanbrack et al. |
| D827,733 | S | 9/2018 | Hochstrasser |
| 10,065,064 | B2 | 9/2018 | Smith et al. |
| 10,071,285 | B2 | 9/2018 | Smith et al. |
| 10,085,586 | B2 | 10/2018 | Smith et al. |
| 10,086,254 | B2 | 10/2018 | Watterson |
| 10,118,064 | B1 | 11/2018 | Cox |
| 10,136,842 | B2 | 11/2018 | Ashby |
| 10,186,161 | B2 | 1/2019 | Watterson |
| 10,188,890 | B2 | 1/2019 | Olson et al. |
| 10,207,143 | B2 | 2/2019 | Dalebout et al. |
| 10,207,145 | B2 | 2/2019 | Tyger et al. |
| 10,207,147 | B2 | 2/2019 | Ercanbrack et al. |
| 10,207,148 | B2 | 2/2019 | Powell et al. |
| 10,212,994 | B2 | 2/2019 | Watterson et al. |
| 10,220,259 | B2 | 3/2019 | Brammer |
| 10,226,396 | B2 | 3/2019 | Ashby |
| 10,226,664 | B2 | 3/2019 | Dalebout et al. |
| 10,252,109 | B2 | 4/2019 | Watterson |
| 10,258,828 | B2 | 4/2019 | Dalebout et al. |
| 10,272,317 | B2 | 4/2019 | Watterson |
| 10,279,212 | B2 | 5/2019 | Dalebout et al. |
| 10,293,211 | B2 | 5/2019 | Watterson et al. |
| D852,292 | S | 6/2019 | Cutler |
| 10,343,017 | B2 | 7/2019 | Jackson |
| 10,376,736 | B2 | 8/2019 | Powell et al. |
| 10,388,183 | B2 | 8/2019 | Watterson |
| 10,391,361 | B2 | 8/2019 | Watterson |
| D864,320 | S | 10/2019 | Weston |
| D864,321 | S | 10/2019 | Weston |
| 10,426,989 | B2 | 10/2019 | Dalebout |
| 10,433,612 | B2 | 10/2019 | Ashby et al. |
| 10,441,840 | B2 | 10/2019 | Dalebout |
| 10,441,844 | B2 | 10/2019 | Powell |
| 10,449,416 | B2 | 10/2019 | Dalebout et al. |
| 10,471,299 | B2 | 11/2019 | Powell |
| D868,909 | S | 12/2019 | Cutler et al. |
| 10,492,519 | B2 | 12/2019 | Capell et al. |
| 10,493,349 | B2 | 12/2019 | Watterson |
| 10,500,473 | B2 | 12/2019 | Watterson |
| 10,537,764 | B2 | 1/2020 | Smith et al. |
| 10,543,395 | B2 | 1/2020 | Powell et al. |
| 10,561,877 | B2 | 2/2020 | Workman |
| 10,561,893 | B2 | 2/2020 | Chatterton et al. |
| 10,561,894 | B2 | 2/2020 | Dalebout et al. |
| 10,569,121 | B2 | 2/2020 | Watterson |
| 10,569,123 | B2 | 2/2020 | Hochstrasser et al. |
| 10,625,114 | B2 | 4/2020 | Ercanbrack |
| 10,625,137 | B2 | 4/2020 | Dalebout et al. |
| 10,661,114 | B2 | 5/2020 | Watterson et al. |
| 10,668,320 | B2 | 6/2020 | Watterson |
| 10,671,705 | B2 | 6/2020 | Capell et al. |
| 10,688,346 | B2 | 6/2020 | Brammer |
| 10,702,736 | B2 | 7/2020 | Weston et al. |
| 10,709,925 | B2 | 7/2020 | Dalebout et al. |
| 10,726,730 | B2 | 7/2020 | Watterson |
| 10,729,965 | B2 | 8/2020 | Powell |
| 10,758,767 | B2 | 9/2020 | Olson et al. |
| 10,786,706 | B2 | 9/2020 | Smith |
| 10,864,407 | B2 | 12/2020 | Watterson et al. |
| 10,918,905 | B2 | 2/2021 | Powell et al. |
| 10,932,517 | B2 | 3/2021 | Ashby et al. |
| 10,940,360 | B2 | 3/2021 | Dalebout et al. |

(56) References Cited

U.S. PATENT DOCUMENTS 10,953,268 B1 3/2021 Dalebout et al.
10,953,305 B2 3/2021 Dalebout et al.
10,967,214 B1 4/2021 Olson et al.
10,994,173 B2 5/2021 Watterson
11,000,730 B2 5/2021 Dalebout et al.
11,013,960 B2 5/2021 Watterson et al.
11,033,777 B1 6/2021 Watterson et al.
11,058,913 B2 7/2021 Dalebout et al.
11,058,914 B2 7/2021 Powell
11,058,918 B1 7/2021 Watterson et al.
11,187,285 B2 11/2021 Wrobel
2002/0016235 A1 2/2002 Ashby et al.
2002/0077221 A1 6/2002 Dalebout et al.
2002/0128127 A1 9/2002 Chen
2002/0159253 A1 10/2002 Dalebout et al.
2003/0171189 A1 9/2003 Kaufman
2004/0091307 A1 5/2004 James
2004/0127335 A1 7/2004 Watterson et al.
2004/0171464 A1 9/2004 Ashby et al.
2004/0171465 A1 9/2004 Hald et al.
2005/0049123 A1 3/2005 Dalebout et al.
2005/0077805 A1 4/2005 Dalebout et al.
2005/0107229 A1 5/2005 Wickens
2005/0164839 A1 7/2005 Watterson et al.
2005/0272577 A1 12/2005 Olson et al.
2005/0277520 A1 12/2005 Van Waes
2006/0135322 A1 6/2006 Rocker
2006/0217237 A1 9/2006 Rhodes
2006/0240959 A1 10/2006 Huang
2007/0066448 A1 3/2007 Pan
2007/0117683 A1 5/2007 Ercanbrack et al.
2007/0197353 A1 8/2007 Hundley
2007/0254778 A1 11/2007 Ashby
2008/0242520 A1 10/2008 Hubbard
2008/0300110 A1 12/2008 Smith et al.
2009/0105052 A1 4/2009 Dalebout et al.
2010/0242246 A1 9/2010 Dalebout et al.
2010/0317488 A1 12/2010 Cartaya
2011/0131005 A1 6/2011 Ueshima
2012/0237911 A1 9/2012 Watterson
2012/0295774 A1 11/2012 Dalebout et al.
2013/0014321 A1 1/2013 Sullivan
2013/0123083 A1 5/2013 Sip
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196822 A1 8/2013 Watterson et al.
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson et al.
2013/0281241 A1 10/2013 Watterson
2014/0024499 A1 1/2014 Watterson
2014/0073970 A1 3/2014 Ashby
2014/0121071 A1 5/2014 Strom et al.
2014/0135173 A1 5/2014 Watterson
2014/0274574 A1 9/2014 Shorten et al.
2014/0274579 A1 9/2014 Olson
2014/0287884 A1 9/2014 Buchanan
2014/0309085 A1 10/2014 Watterson et al.
2015/0182781 A1 7/2015 Watterson
2015/0196805 A1* 7/2015 Koduri ..... A63B 24/0087 482/6
2015/0238817 A1 8/2015 Watterson
2015/0250418 A1 9/2015 Ashby
2015/0251055 A1 9/2015 Ashby
2015/0253210 A1 9/2015 Ashby et al.
2015/0253735 A1 9/2015 Watterson
2015/0253736 A1 9/2015 Watterson
2015/0258560 A1 9/2015 Ashby
2015/0367161 A1 12/2015 Wiegardt
2016/0058335 A1 3/2016 Ashby
2016/0059064 A1 3/2016 Smith et al.
2016/0063615 A1 3/2016 Watterson
2016/0092909 A1 3/2016 Watterson
2016/0101311 A1 4/2016 Workman
2016/0107065 A1 4/2016 Brammer
2016/0121074 A1 5/2016 Ashby
2016/0148535 A1 5/2016 Ashby
2016/0148536 A1 5/2016 Ashby
2016/0158595 A1 6/2016 Dalebout
2016/0206248 A1 7/2016 Sartor et al.
2016/0206922 A1 7/2016 Dalebout et al.
2016/0250519 A1 9/2016 Watterson
2016/0253918 A1 9/2016 Watterson
2016/0339298 A1 11/2016 Kats
2016/0346595 A1 12/2016 Dalebout et al.
2016/0346617 A1 12/2016 Srugo et al.
2017/0036053 A1 2/2017 Smith et al.
2017/0056711 A1 3/2017 Dalebout et al.
2017/0056715 A1 3/2017 Dalebout et al.
2017/0056726 A1 3/2017 Dalebout et al.
2017/0124912 A1 5/2017 Ashby et al.
2017/0193578 A1 7/2017 Watterson
2017/0266483 A1 9/2017 Dalebout et al.
2017/0266489 A1 9/2017 Douglass et al.
2017/0266532 A1 9/2017 Watterson
2017/0270820 A1 9/2017 Ashby
2018/0001135 A1 1/2018 Powell
2018/0036585 A1 2/2018 Powell
2018/0084817 A1 3/2018 Capell et al.
2018/0085630 A1 3/2018 Capell et al.
2018/0089396 A1 3/2018 Capell et al.
2018/0099116 A1 4/2018 Ashby
2018/0099179 A1 4/2018 Chatterton et al.
2018/0099180 A1 4/2018 Wilkinson
2018/0099205 A1 4/2018 Watterson
2018/0111034 A1 4/2018 Watterson
2018/0117383 A1 5/2018 Workman
2018/0117385 A1 5/2018 Watterson et al.
2018/0117393 A1 5/2018 Ercanbrack
2018/0154207 A1 6/2018 Hochstrasser
2018/0154208 A1 6/2018 Powell et al.
2018/0200566 A1 7/2018 Weston
2019/0058370 A1 2/2019 Tinney
2019/0080624 A1 3/2019 Watterson
2019/0168072 A1 6/2019 Brammer
2019/0178313 A1 6/2019 Wrobel
2019/0192898 A1 6/2019 Dalebout
2019/0192952 A1 6/2019 Powell
2019/0209893 A1 7/2019 Watterson
2019/0223612 A1 7/2019 Watterson
2019/0269971 A1 9/2019 Capell et al.
2019/0275366 A1 9/2019 Powell
2019/0282852 A1 9/2019 Dalebout
2019/0328079 A1 10/2019 Ashby et al.
2019/0329091 A1 10/2019 Powell et al.
2019/0376585 A1 12/2019 Buchanan
2020/0009417 A1 1/2020 Dalebout
2020/0222751 A1 7/2020 Dalebout
2020/0338389 A1 7/2020 Dalebout
2020/0254295 A1 8/2020 Watterson
2020/0254309 A1 8/2020 Watterson
2020/0254311 A1 8/2020 Watterson
2020/0391069 A1 8/2020 Olson
2020/0368575 A1 11/2020 Hays
2021/0001177 A1 1/2021 Smith
2021/0046351 A1 2/2021 Ercanbrack
2021/0046353 A1 2/2021 Dalebout
2021/0086018 A1 3/2021 Dalebout
2021/0086032 A1 4/2021 Watterson et al.
2021/0106899 A1 4/2021 Willardson

OTHER PUBLICATIONS

Octane Fitness; "Consumer Adapter Kit For Cross Circuit Pro—Safety and Assembly Instructions"; Instruction Manual; 2011; 4 pages; located at: https://www.octanefitness.com/home/wp-content/

(56) References Cited

OTHER PUBLICATIONS uploads/sites/2/2014/01/106082-001-REV-A-INSTRUCTIONS-CONSUMER-ADAPTER-FOR-CCPRO-2.22.11.pdf.
Octane Fitness; Cross Circuit Pro Kit—XT One Assembly & Set-Up Instructions; Instruction Manual; 2016; 20 pages; located at: https://www.octanefitness.com/wp-content/uploads/2016/11/110786-001-REV-C-INSTRUCTIONS-CROSS-CIRCUIT-PRO-XT-ONE-UnR.pdf.
Octane Fitness; Product Programs and Features; Instruction Manual; 2017; 56 pages; located at: https://www.octanefitness.com/home/wp-content/uploads/sites/2/2017/04/110751-001-REV-E-PROGRAMS-FEATURES-COMM-ENG.pdf.
Octane Fitness; Octane Fitness Cross Circuit; Webpage; accessed on Nov. 30, 2018; located at: https://www.octanefitness.com/commercial/cross-circuit/.
International Search Report and Written Opinion issued in PCT/US2017/022989 dated May 23, 2017.
U.S. Appl. No. 63/316,890.
Defendant Peloton Interactive, Inc.'s Answer and Counterclaims filed Feb. 11, 2022 in the United States Court for the District of Delaware.
Manual for NordicTrack Grand Tour Pro Bike.
Manual for Proform 5.0 CrossTrainer Treadmill.
Manual for ProForm 600.
Manual for ProForm 700 GX.
Manual for ProForm CrossTrainer 55.
Manual for ProForm CrossTrainer 56.
Manual for ProForm CrossTrainer 970.
Manual for ProForm CT1160.
Manual for ProForm CT1260.
U.S. Appl. No. 29/568,648, filed Jun. 20, 2016, ICON Health and Fitness, Inc.
U.S. Appl. No. 29/702,127, filed Sep. 16, 2019, ICON Health and Fitness, Inc.
U.S. Appl. No. 13/088,007, filed Apr. 15, 2011, Scott R. Watterson.
U.S. Appl. No. 15/821,386, filed Nov. 22, 2017, ICON Health & Fitness, Inc.
U.S. Appl. No. 15/973,176, filed May 7, 2018, Melanie Douglass.
U.S. Appl. No. 16/378,022, filed Apr. 8, 2019, William T. Dalebout.
U.S. Appl. No. 16/435,104, filed Jun. 7, 2019, Dale Alan Buchanan.
U.S. Appl. No. 16/506,085, filed Jul. 9, 2019, ICON Health & Fitness, Inc.
U.S. Appl. No. 62/697,833, filed Jul. 13, 2018, ICON Health & Fitness, Inc.
U.S. Appl. No. 62/796,952, filed Jan. 25, 2019, ICON Health & Fitness, Inc.
U.S. Appl. No. 62/804,146, filed Feb. 11, 2019, ICON Health & Fitness, Inc.
U.S. Appl. No. 62/804,685, filed Feb. 12, 2019, ICON Health & Fitness, Inc.
U.S. Appl. No. 62/852,118, filed May 22, 2019, David Hays.
U.S. Appl. No. 62/866,576, filed Jun. 25, 2019, ICON Health & Fitness, Inc.
U.S. Appl. No. 62/887,391, filed Aug. 15, 2019, ICON Health & Fitness, Inc.
U.S. Appl. No. 62/887,398, filed Aug. 15, 2019, ICON Health & Fitness, Inc.
U.S. Appl. No. 62/897,113, filed Sep. 9, 2019, ICON Health & Fitness, Inc.
U.S. Appl. No. 62/842,118, filed May 23, 2019, ICON Health & Fitness, Inc.
U.S. Appl. No. 62/912,451, filed Sep. 9, 2019, Megan Jane Ostler.
U.S. Appl. No. 29/702,127, filed Sep. 16, 2019, Gordon Cutler.
U.S. Appl. No. 63/073,081, filed Sep. 1, 2020, Darren C. Ashby.
U.S. Appl. No. 17/014,935, filed Sep. 8, 2020, Megan Jane Ostler.
U.S. Appl. No. 63/079,697, filed Sep. 17, 2020, Jared Willardson.
U.S. Appl. No. 63/086,793, filed Oct. 2, 2020, Darren C. Ashby.
U.S. Appl. No. 17/066,485, filed Oct. 9, 2020, Jared Weston.
U.S. Appl. No. 17/096,350, filed Nov. 12, 2020, William T. Dalebout.
U.S. Appl. No. 17/141,880, filed Jan. 5, 2021, Wade A. Powell.
U.S. Appl. No. 63/134,036, filed Jan. 5, 2021, Gaylen Ercanbrack.
U.S. Appl. No. 17/149,299, filed Jan. 14, 2021, William T. Dalebout.
U.S. Appl. No. 17/159,814, filed Jan. 27, 2021, William T. Dalebout.
U.S. Appl. No. 17/172,880, filed Feb. 10, 2021, Darren C. Ashby.
U.S. Appl. No. 63/150,066, filed Feb. 16, 2021, Kent M. Smith.
U.S. Appl. No. 17/178,173, filed Feb. 17, 2021, Evan Charles Tinney.
U.S. Appl. No. 63/156,801, filed Mar. 4, 2021, Eric S. Watterson.
U.S. Appl. No. 17/204,704, filed Mar. 17, 2021, Chris Nascimento.
U.S. Appl. No. 17/209,714, filed Mar. 23, 2021, Chase Brammer.
U.S. Appl. No. 63/165,498, filed Mar. 24, 2021, Mark Archer.
U.S. Appl. No. 63/200,903, filed Apr. 2, 2021, Eric S. Watterson.
U.S. Appl. No. 17/217,938, filed Apr. 8, 2021, Eric S. Watterson.

* cited by examiner

STATIONARY EXERCISE MACHINE CONFIGURED TO EXECUTE A PROGRAMMED WORKOUT WITH AEROBIC PORTIONS AND LIFTING PORTIONS

RELATED APPLICATIONS

This application is a continuation of U.S. patent application Ser. No. 17/115,690 filed Dec. 8, 2020, which is a continuation of U.S. patent application Ser. No. 16/299,668 filed Mar. 12, 2019, which is a continuation of U.S. patent application Ser. No. 15/461,040 filed Mar. 16, 2017, which claims priority to U.S. Patent Application Ser. No. 62/310,503 filed on Mar. 18, 2016, which applications are herein incorporated by reference for all that they disclose.

BACKGROUND

While numerous exercise activities exist that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. These exercises usually include low or moderate resistance to the movement of the individual. For example, aerobic exercise includes activities such as walking, running, jogging, swimming, or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups, or a series of short sprints.

To build skeletal muscle, a muscle group is contracted against resistance. The contraction of some muscle groups produces a pushing motion, while the contraction of other muscle groups produces a pulling motion. One type of exercise device that provides resistance to user's muscle contraction is a dumbbell. A dumbbell often includes a handle and weights at either end of the handle. In some cases, the weights are permanently affixed to the handle. Other types of dumbbells are adjustable where the weights can be removed and/or added to allow the user to adjust the amount of weight on the dumbbell.

One type of dumbbell is disclosed in U.S. Pat. No. 7,172,536 issued to Wei Ming Liu. In this reference, an adjustable dumbbell includes a number of weights each having a slot to receive end portions of a bar, and a number of latch rods slidably engaged in the weights and each having an inner end engageable into the slots of the weights and engageable with the bar, to anchor and latch a selected number of the weights to the bar, and to allow the selected weights to be moved in concert with the bar. The weights each have a spring member to bias and force the inner end of the latch rod to engage with and to latch the weights to the bar. The weights each include a panel having an orifice to slidably receive the latch rod, and to anchor the latch rod to the panel when the catch of the knob is rotated relative to the panel. Other types of dumbbells are described in U.S. Pat. No. 6,500,101 issued to James Chen, U.S. Patent Publication No. 2004/0005968 issued to Douglas A. Crawford, et al., U.S. Patent Publication No. 2012/0115689 issued to William Dalebout, et al., and WIPO International Publication No. WO/1994/017862 issued to Carl K. Towley. Each of these documents are herein incorporated by reference for all that they contain.

SUMMARY

In some embodiments, a stationary exercise machine may include an aerobic exercise element configured to be movable during execution of a programmed workout, a display, one or more processors, and memory. The memory may be configured to store programmed instructions of the programmed workout that, when executed by the one or more processors, cause the one or more processors to: automatically alternate, by the programmed instructions of the programmed workout, between aerobic portions of the programmed workout and lifting portions of the programmed workout, automatically control, by the programmed instructions of the programmed workout, a speed, or a resistance level, of the aerobic exercise element during the aerobic portions of the programmed workout, automatically present, by the programmed instructions of the programmed workout, lifting instructions on the display, the lifting instructions configured to instruct a user on lifting one or more free weights during the lifting portions of the programmed workout.

In some embodiments, the lifting instructions may further instruct the user on performing a specific exercise with the one or more free weights.

In some embodiments, the lifting instructions may further instruct the user on types of lifts to perform, and a number of repetitions to perform with each of the types of lifts, using the one or more free weights.

In some embodiments, the lifting instructions may further instruct the user on how to perform a lift using the one or more free weights.

In some embodiments, the lifting instructions may further instruct the user on a safety precaution about a lift using the one or more free weights.

In some embodiments, the lifting instructions may further instruct the user on pacing information associated with a lift using the one or more free weights.

In some embodiments, the lifting instructions may further instruct the user to perform negatives using the one or more free weights by lifting up the one or more free weights relatively quickly and lowering down the one or more free weights relatively slowly.

In some embodiments, the lifting instructions may further instruct the user to lift up the one or more free weights and lower down the one or more free weights at a same rate.

In some embodiments, the lifting instructions may include written words and images.

In some embodiments, the stationary exercise machine may further include an upright portion that has a console that includes the display, and the lifting instructions may further instruct the user to lift the one or more free weights in a free weight area in a front end of the stationary exercise machine proximate the upright portion.

In some embodiments, the stationary exercise machine may further include a speaker, and the speaker may be configured to audibly broadcast at least a portion of the lifting instructions.

In some embodiments, the programmed instructions of the programmed workout, when executed by the one or more processors, may further cause the one or more processors to simultaneously: automatically present, by the programmed instructions of the programmed workout, aerobic instructions on the display during a current one of the aerobic portions of the programmed workout, the aerobic instructions configured to instruct the user about a current aerobic exercise activity during the current one of the aerobic portions of the programmed workout, and automatically present, by the programmed instructions of the programmed workout, lifting instructions on the display for an upcoming one of the lifting portions of the programmed workout.

In some embodiments, the programmed instructions of the programmed workout, when executed by the one or more processors, may further cause the one or more processors to: automatically present, by the programmed instructions of the programmed workout, warm up instructions on the display, the warm up instructions configured to instruct the user on performing a warm up activity of the programmed workout, and automatically present, by the programmed instructions of the programmed workout, cool down instructions on the display, the cool down instructions configured to instruct the user on performing a cool down activity of the programmed workout.

In some embodiments, the memory may be further configured to store a library of programmed workouts from which the programmed workout can be selected by the user, and the library of programmed workouts may be downloadable to the memory from a remote network location over a Wi-Fi network connection.

In some embodiments, the one or more free weights may include dumbbells.

In some embodiments, the stationary exercise machine may include a stationary bicycle, and the aerobic exercise element may include pedals.

In some embodiments, the stationary exercise machine may include a stationary treadmill, and the aerobic exercise element may include a tread belt.

In some embodiments, a stationary exercise machine may include an aerobic exercise element configured to be movable during execution of a programmed workout, an upright portion that has a console that includes a display, one or more processors, and memory. The memory may be configured to store a library of programmed workouts from which the programmed workout can be selected by a user. The memory may be further configured to have the library of programmed workouts downloaded to the memory from a remote network location over a Wi-Fi network connection. The memory may further be configured to store programmed instructions of the programmed workout that, when executed by the one or more processors, cause the one or more processors to: automatically present, by the programmed instructions of the programmed workout, warm up instructions on the display, the warm up instructions configured to instruct the user on performing a warm up activity of the programmed workout, automatically alternate, by the programmed instructions of the programmed workout, between aerobic portions of the programmed workout and lifting portions of the programmed workout, automatically control, by the programmed instructions of the programmed workout, a speed, or a resistance level, of the aerobic exercise element during the aerobic portions of the programmed workout, automatically present, by the programmed instructions of the programmed workout, aerobic instructions on the display, the aerobic instructions configured to instruct the user about aerobic exercise activity during the aerobic portions of the programmed workout, automatically present, by the programmed instructions of the programmed workout, lifting instructions on the display, the lifting instructions configured to instruct the user on lifting one or more free weights during the lifting portions of the programmed workout, and automatically present, by the programmed instructions of the programmed workout, cool down instructions on the display, the cool down instructions configured to instruct the user on performing a cool down activity of the programmed workout.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
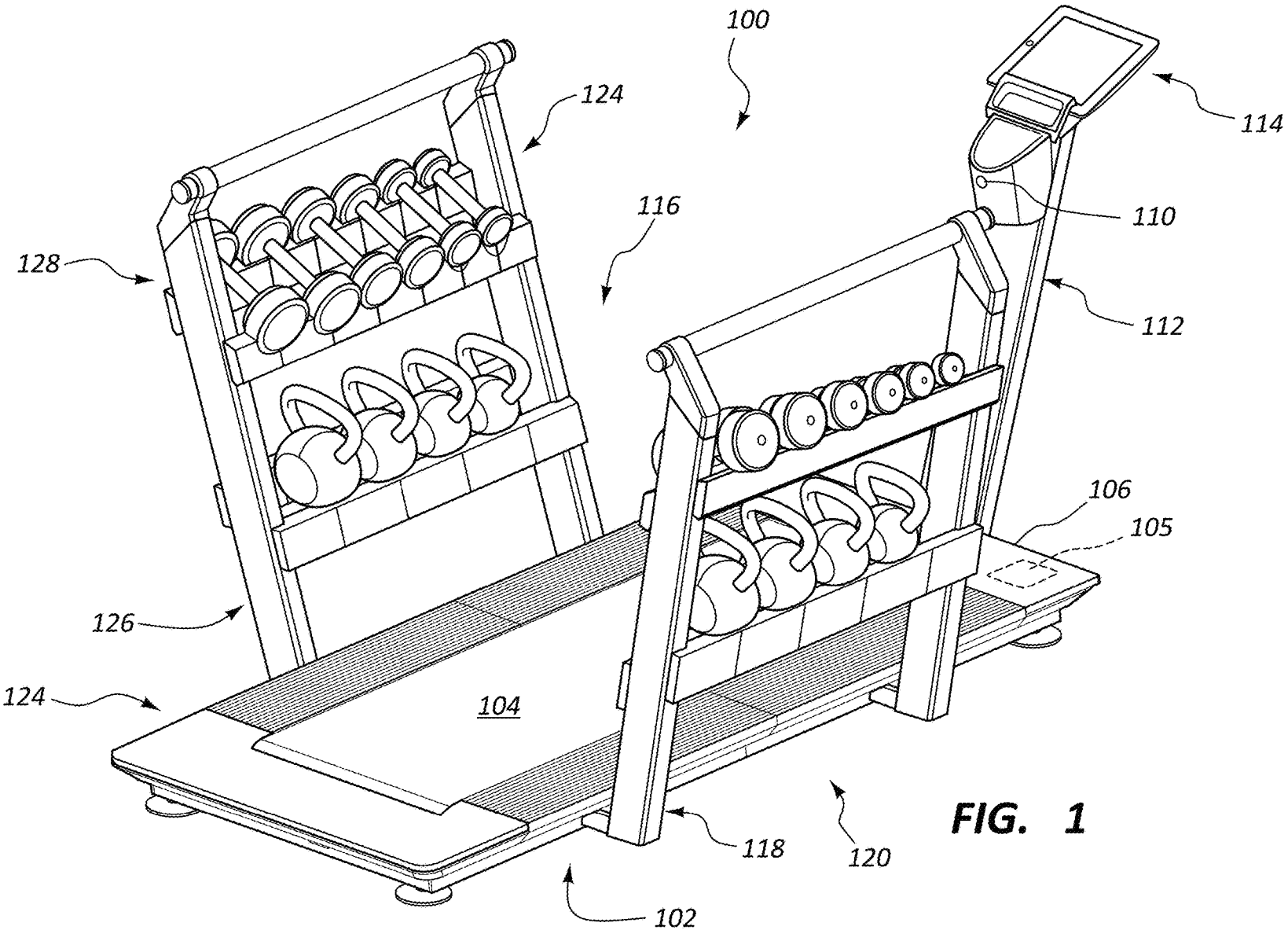
FIG. 1 illustrates a perspective view of an example of a treadmill in accordance with the present disclosure.

FIG. 1 depicts an example of a treadmill 100 having a deck 102 with a first pulley disposed in a first portion of the deck 102 and a second pulley incorporated into a second portion of the deck 102. A tread belt 104 surrounds the first pulley and the second pulley. A motor 105 is in mechanical communication with either the first pulley or the second pulley. A cover 106 is superjacent the motor 105. A repetition counter 110 is also incorporated into the treadmill. The treadmill 100 includes an upright portion 112 that supports a console 114. In this example, the repetition counter 110 is incorporated into the upright portion 112.

Also incorporated into the treadmill 100 is a free weight cradle 120. In this example, a first portion 118 of the free weight cradle 120 is connected to a first side 116 of the deck 102, and a second portion 122 of the free weight cradle 120 is connected to a second side 124 of the deck 102. The free weight cradle 120 may include multiple tiers. In this example, each of the portions of the free weight cradle include a first tier 126 and a second tier 128. In some cases, each of the tiers includes a cross member that includes features that prevent the free weights from slipping off of the rack. For example, the feature may include a lip, a recess, another type of feature, or combinations thereof.

Figure 2:
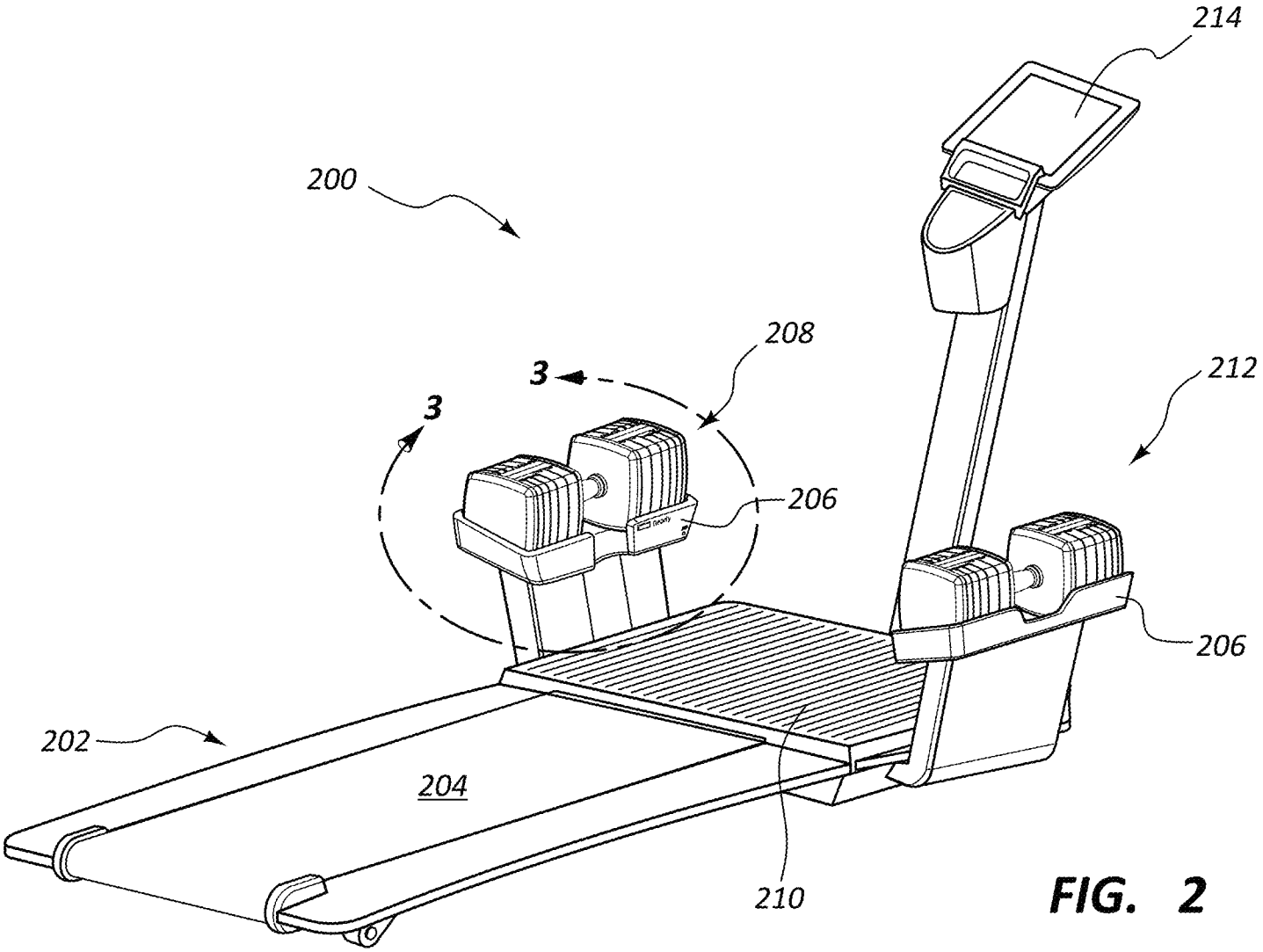
FIG. 2 illustrates a perspective view of an example of a treadmill in accordance with the present disclosure.

FIG. 2 depicts an example of a treadmill 200. In this example, the treadmill 200 includes a deck 202, and with a tread belt 204 that surrounds a first pulley and second pulley incorporated into the deck 202. A free weight cradle 206 is also incorporated into the treadmill 200. In this example, the free weight cradle 206 includes just a single tier and supports an adjustable dumbbell 208.

A weight scale 210 is incorporated into the deck 202 at a front end 212 of the treadmill 200. In this example, the weight scale 210 is positioned over the motor that drives the first pulley and therefore drives the tread belt 204. As a user stands on the weight scale 210, the weight of the user can be presented in the console 214, in a display incorporated into the weight scale 210, to a mobile device or other computing device in communication with the weight scale, or combinations thereof. Additionally, when the user lifts the free weights off of the cradle 206, the weight scale measures the combined weight of the user and the free weights. In some cases, the fluctuation of the weight scale's measurements that occur as the user performs an anaerobic exercise with the free weights is used by the repetition counter to determine how many lifts the user has performed.

Figure 3:
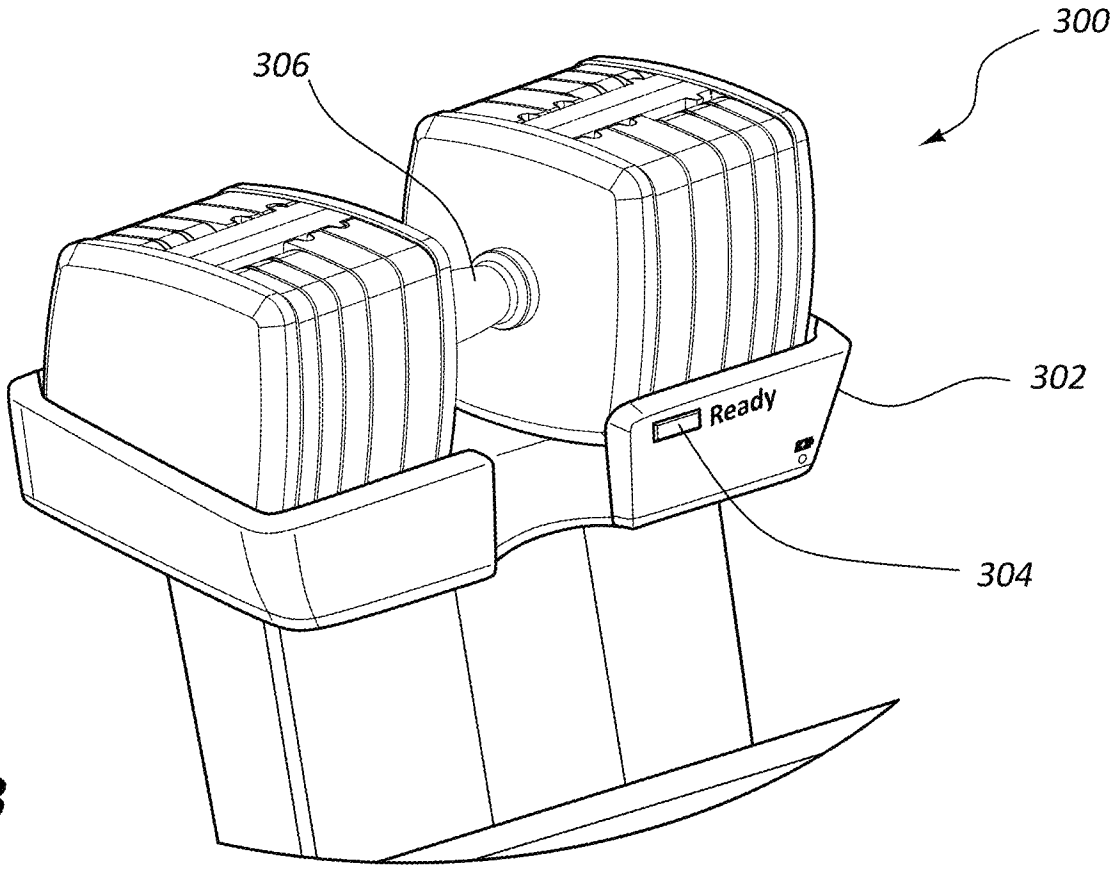
FIG. 3 illustrates a perspective view of an example of an adjustable dumbbell and a cradle in accordance with the present disclosure.

FIG. 3 depicts an adjustable dumbbell 300. In this example, the adjustable dumbbell is positioned in a cradle 302. The cradle 302 includes an indicator 304 that communicates to the user that it is time to pick up the adjustable dumbbell 300. In this example, the indicator 304 includes a light. In this example, the light can illuminate when the proper amount of weight has been mechanically connected to the handle 306 of the adjustable dumbbell. For example, the free weights positioned in the cradle and/or free weight cradle may include a fixed dumbbell, a kettle weight, a bar bell, another type of weight, or combinations thereof. The indicator 304 may indicate to the user when it is time to pick up the free weight. In some cases, multiple indicators are incorporated into a cradle and are associated with a different weight amount. For example, the cradle may include a position for a 10 pound free weight, a 15 pound free weight, and 20 pound free weight. A first indicator may correspond to the 10 pound weight, a second indicator may correspond to the 15 pound weight, and a third indicator may correspond with the 20 pound weight. When it is time for the user to use the 10 pound weight, the light of the first indicator may illuminate. Likewise, when it is time for the user to use the 20 pound weight, the light of the third indicator may illuminate.

In other examples, the free weight is another type of weight other than an adjustable dumbbell. The cradle may be any appropriate type of cradle. In some examples, the cradle includes a recess that is sized to the dimensions of the free weight intended to be located into that spot in the cradle. In other examples, the cradle may include a shelf that can accommodate free weights of varying size and dimensions.

Figure 4:
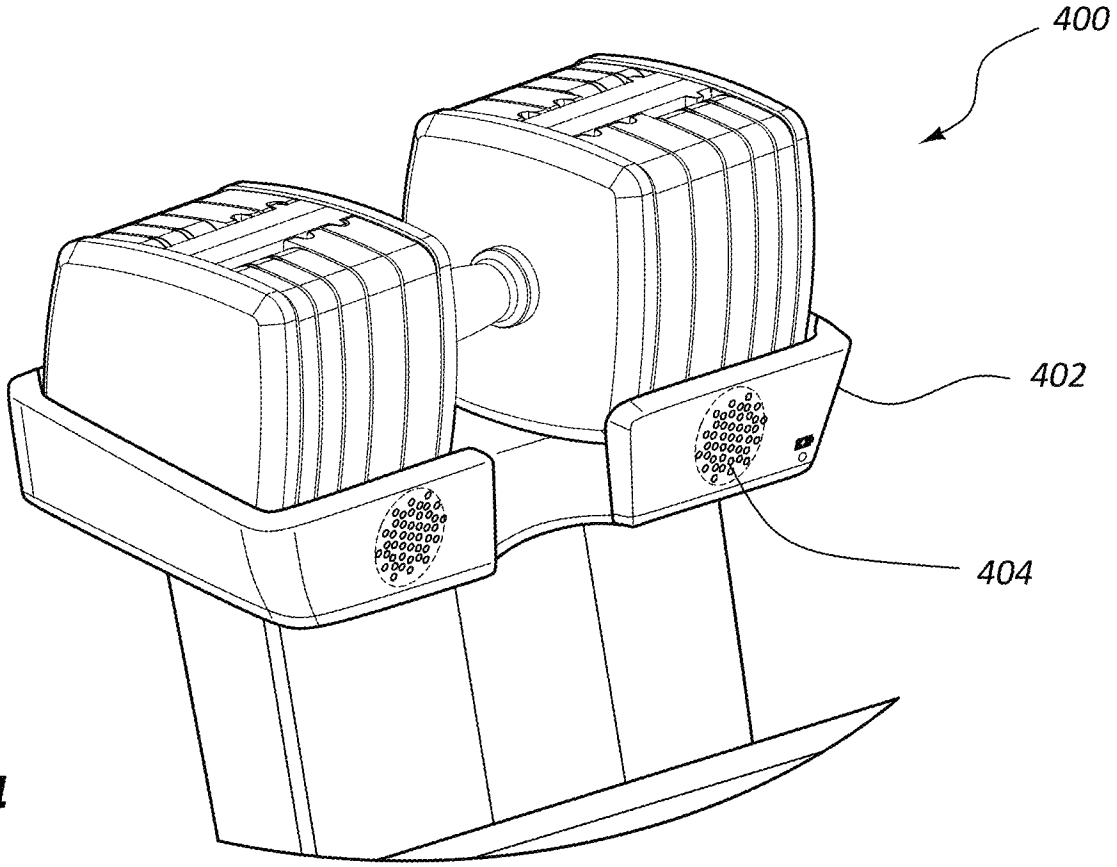
FIG. 4 illustrates a perspective view of an example of an adjustable dumbbell and a cradle in accordance with the present disclosure.

FIG. 4 depicts an adjustable dumbbell 400. In this example, the adjustable dumbbell is positioned in a cradle 402. The cradle 402 includes an indicator 404 that communicates to the user that it is time to pick up the adjustable dumbbell 400. In this example, the indicator 404 includes a speaker.

Figure 5:
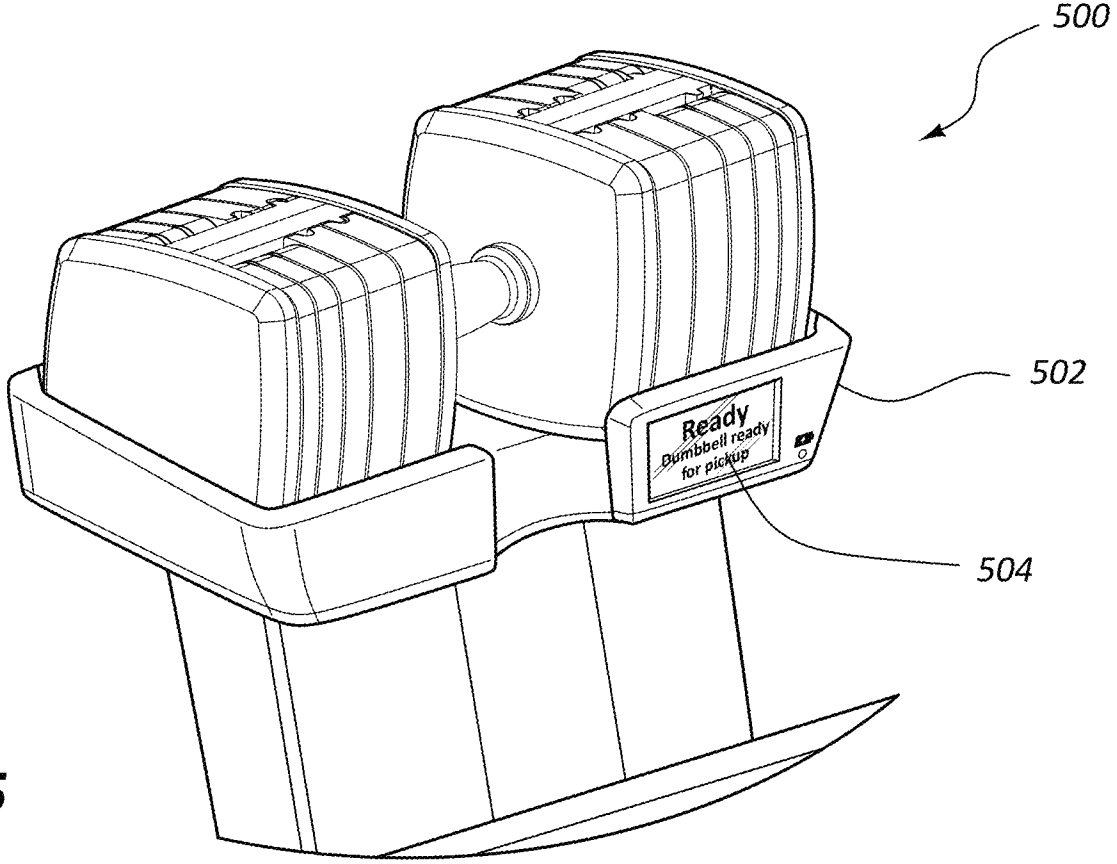
FIG. 5 illustrates a perspective view of an example of an adjustable dumbbell and a cradle in accordance with the present disclosure.

FIG. 5 depicts an adjustable dumbbell 500. In this example, the adjustable dumbbell is positioned in a cradle 502. The cradle 502 includes an indicator 504 that communicates to the user when the time to pick up the adjustable dumbbell 500 has arrived. In this example, the indicator 504 includes a display. In this example, the display indicates that it is time for the user to use the adjustable dumbbell 500 by presenting written words the display's screen. In other examples, the display may indicate to the user that it is time to use the weights by presenting an image related to lifting the weights. In yet another example, the display may indicate which amount of weight to lift, the type of lift to perform, the number of repetitions to do with each lift, safety precautions about each lift, other information, or combinations thereof.

The indicator may be connected to any appropriate portion of the free weight assembly. For example, the indicator can be connected to the adjustable dumbbell, a weight plate, another kind of free weight, the cradle, a cradle stand, other portion of the free weight assembly, or combinations thereof.

Figure 6:
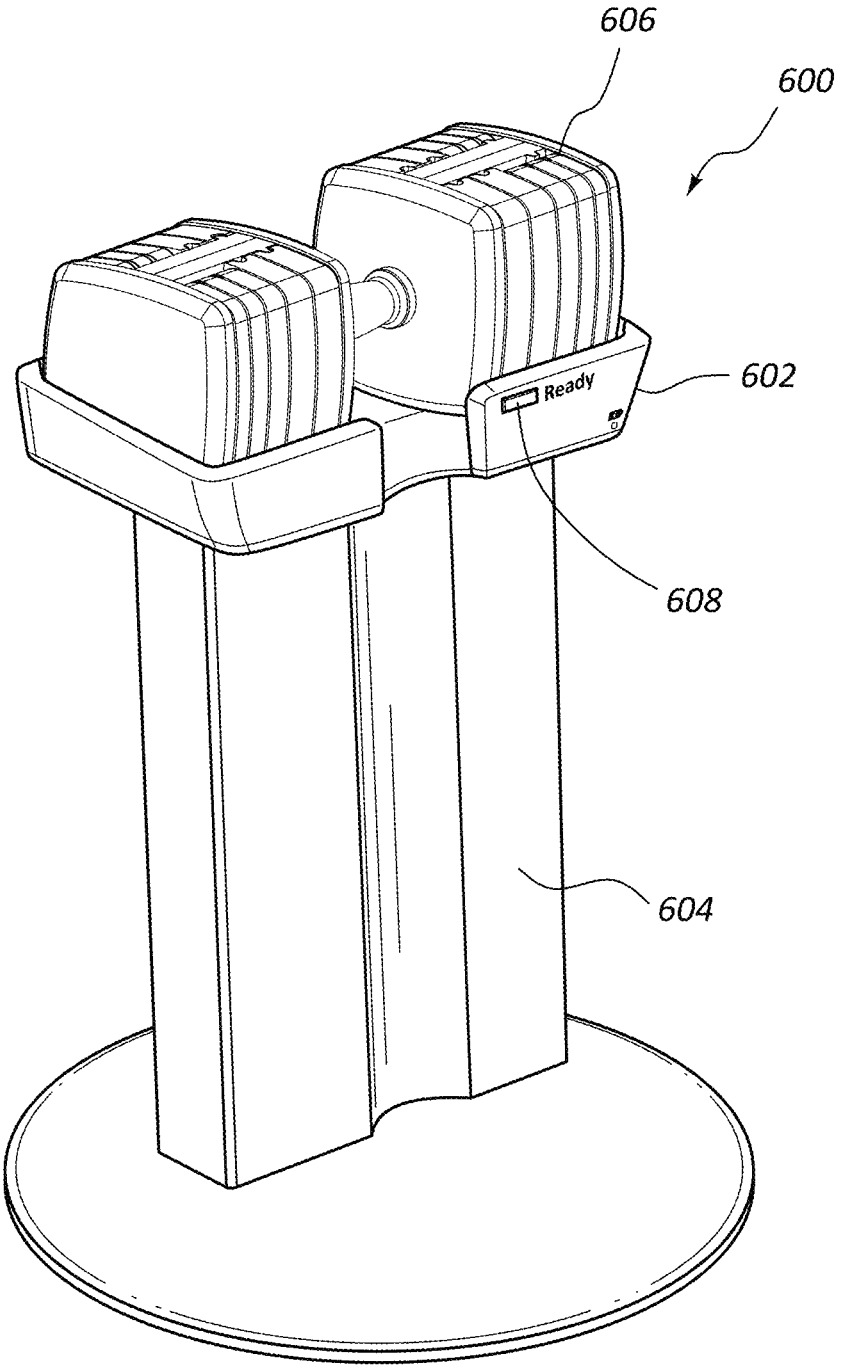
FIG. 6 illustrates a perspective view of an example of an adjustable dumbbell and a cradle in accordance with the present disclosure.

FIG. 6 depicts an example of a free weight assembly 600. In this example, a cradle 602 is supported on a stand 604. An adjustable dumbbell 606 is positioned in the cradle 602. An indicator 608 that indicates when the time has arrived to lift the adjustable dumbbell 606 out of the cradle 602 is incorporated into the cradle 602. In other examples, the indicator 608 is incorporated into the stand 604.

Figure 7:
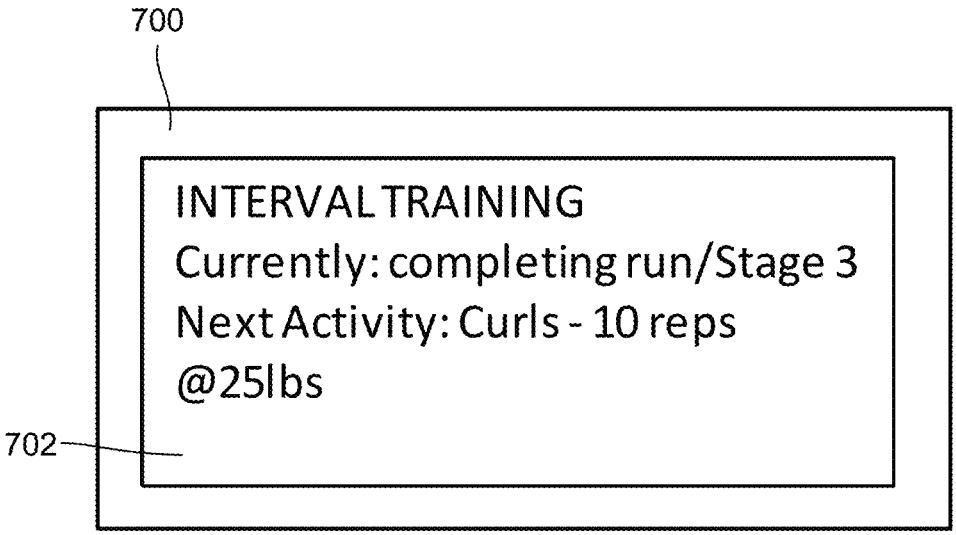
FIG. 7 depicts an example of a display incorporated into a free weight assembly.

FIG. 7 depicts an example of a display 700 incorporated into a free weight assembly. In this example, the display 700 includes a screen 702 that depicts exercise instructions to the user. The instructions provide details about the exercise activity that the user is instructed to currently be executing. In this example, the current activity is a running activity. The instructions also include the activity that the user will be instructed to execute after completing the current activity. In this example, the upcoming activity is a lifting activity.

GENERAL DESCRIPTION

In general, the invention disclosed herein may provide a user with a free weight assembly that can instruct the user on when to perform a lift with the free weights of the assembly. In some examples, the invention provides the user with a weight amount indication of what the user is to lift. An example of this aspect of the invention may include when a cradle of the assembly holds multiple free weights with varying amounts of mass. Different indicators incorporated into the assembly can indicate to the user when to pick up the different free weights by activating just those indicators that are associated with the intended free weights.

The free weight assembly may be part of an exercise machine that includes both aerobic and anaerobic components. For example, the exercise machine may include, in addition to the free weights, an aerobic exercise element that is movable with respect to the free weight's cradle during the performance of an exercise. In some cases, the aerobic exercise element is a tread belt, a pedal, a pull cable, another type of aerobic exercise element, or combinations thereof. In these situations, the free weight cradle may be incorporated into a treadmill, an elliptical trainer, a stepper machine, a stationary bicycle, a rowing machine, another type of exercise machine with an aerobic exercise component, or combinations thereof. In some cases, a display instructing the user to perform activities with the exercise machine may instruct the user to use the aerobic exercise element for anaerobic activities. For example, interval training with pedals or a tread belt is considered to be an anaerobic activity and the program can instruct the user to use the aerobic exercise element for both types of activities.

In some cases, a free weight assembly is incorporated into a treadmill or another type of exercise device. In examples where the free weight assembly is incorporated into a treadmill, the free weight cradle may have a first portion incorporated into a first side of the treadmill and a second portion of the cradle may be incorporated into a second side of the treadmill. Each portion of the free weight cradle may position the free weights within a convenient reach of each of the user's hands when the user is standing on the treadmill's deck. Thus, the free weights may be accessible to the user as the user is on the exercise deck.

The treadmill may include a running deck that has a first pulley and a second pulley. A tread belt may surround the first pulley and the second pulley. A motor can be attached to either the first or the second pulley so that as the motor rotates its shaft, the connected pulley also rotates. The rotation of the connected pulley, then drives movement of the tread belt. In those examples where the treadmill includes just a single motor, the movement of the tread belt drives movement of the other pulley that is not connected to the motor.

For purposes of this disclosure, the term "free weight" refers broadly to free weights that are intended to be used to execute an anaerobic exercise. In some cases, the free weights may be intended to be held in a single hand. Frees weights intended for the user's first hand are positioned in the first portion of the free weight cradle, and free weights intended for the user's second hand are positioned in the second portion of the free weight cradle. These free weights may include dumbbells, kettle balls, balls, adjustable dumbbells, weight plates, Bulgarian bags, other types of weighted bags, barbells, curl bars, other types of free weights, or combinations thereof.

In some cases, the user can work out on the portion of the exercise deck that includes the tread belt. In this example, the user may desire to mix up the anaerobic exercise and aerobic exercise portions of his or her workout. During the anaerobic portions of the workout, the tread belt may be stopped while the user performs the free weight exercises. When the anaerobic portion of the workout is completed, the user may resume the operation of the tread belt to perform an aerobic portion of the workout. In other examples, the user may want to use the free weights while the tread belt is in operation. For example, the user may want to carry dumbbells during a run.

In other examples, the treadmill incorporates a separate area on the exercise deck where the user can perform exercises with the free weights. In some cases, this free weight area may be in the front end of the treadmill proximate an upright portion of the treadmill that has a console. The console can provide information about the user's workout such as the time, distance, and speed at which the user executed the aerobic portions of the workout.

In some situations, the treadmill guides the user with a programmed workout. In some cases, the programmed workout alters the tread belt's speed, the incline of the deck, and other factors affecting the aerobic portion of the workout. Additionally, the programmed workout may include anaerobic portions as well. In these instances, the programmed workout may instruct the user to perform certain types of lifts with the free weights. In some cases, the programmed workout may select the amount of weight that the user is to lift. In embodiments where the free weight cradle includes an adjustable dumbbell, the treadmill may cause the adjustable dumbbell to select the amount of weight prescribed by the programmed workout. In other instances, the treadmill may allow the user to manually select the amount of weight to connect to the dumbbell's handle even if the programmed workout is providing the user with instructions to lift a predetermined amount.

The predetermined amount of weight recommended in the programmed workout may be based on information about the user. This information may be derived from a history compiled with fitness trackers, previous workouts on the treadmill, age information, height information, body composition information, gender information, other types of personal information, or combinations thereof. In some instances, the treadmill is in communication with a remote computing device that contains a user profile detailing fitness information about the user. The treadmill or a remote computing device may also take into consideration the user's fitness goals when selecting the type of lifts to perform, the amount of weight to perform with the lifts, and the number of repetitions.

In some cases, the programmed workout's instructions are presented to the user through a display in the console. The programmed workout can present the number of lifts to perform, the type of lifts to perform, the next type of exercise to perform, and so forth. In some case, the display screen can instruct the user on how to perform the lift. For instance, the programmed workout may instruct the user to perform negatives by lifting up quickly and lowering the free weight slowly, or the programmed workout may instruct the user to perform the same type of lift a different way, such as instructing the user to lift up and lower the free weight at the same rate. In other examples, a speaker may be used to audibly instruct the user about the programmed workout.

Information relating to both the anaerobic portions of the workout and the aerobic portions of the workout can be presented to the user. For instance, the repetition count may be presented in the display, the calories burned during the workout may be presented in the display, the user's heart rate, or other physiological parameters may be presented in the display, and so forth.

In some case, the treadmill is in communication with a remote device, and the information recorded about the workout is sent to the remote device. In one instance, the information is sent to the user's mobile device and the user follows the workout with his or her mobile device.

The display that depicts exercise instructions to the user may include any appropriate type of instructions for any type of activity associated with a work out. For example, the instructions may include for an aerobic activity, an anaerobic activity, a stretching activity, a warm up activity, a cool down activity, another type of activity, or combinations thereof. The instructions provide details about the exercise activity that the user is instructed to currently be executing, an activity that the user will be instructed to execute after completing the current activity, other activities that the will be executed in the future during the workout, activities that have already been executed during the workout, and combinations thereof. In some examples, the display tracks the user's success in accomplishing the exercise, at least one of the user's physiological parameters during the execution of the activity, or combinations thereof. In some examples, the display presents both aerobic and anaerobic activities at the same time.

The instruction system for instructing the user about the workout may include a combination of hardware and programmed instructions for executing the functions of the instruction system. The instruction system may include processing resources that are in communication with memory resources. Processing resources include at least one processor and other resources used to process the programmed instructions. As described herein, the memory resources may represent generally any memory capable of storing data such as programmed instructions or data structures used by the instruction system.

The processing resources may include 110 resources that are capable of being in communication with a remote device that stores the user information, workout history, external resources, databases, or combinations thereof. The remote device may be a mobile device, a cloud based device, a computing device, another type of device, or combinations thereof. In some examples, the system communicates with the remote device through a mobile device which relays communications between the instruction system and the remote device. In other examples, the mobile device has access to information about the user. The remote device may collect information about the user throughout the day, such as tracking calories, exercise, activity level, sleep, other types of information, or combination thereof.

The remote device may execute a program that can provide useful information to the instruction system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the instruction system through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

In some cases, the user can select a programmed workout from a library of programs that are included in the memory resources, which may be physically located in the free weight assembly, an exercise device associated with the free weight assembly, or a remote device. In other examples, the user selects a goal, like a weight strength goal, a fat loss goal, a muscle gain goal, a health goal, a fitness goal, another type of goal, or combinations thereof, and the memory resources cause the processing resources to create a programmed workout that is customized to the user's goals. The programmed workout can control the operating parameters of the free weight assembly, such as causing the indicator to activate when it is time for the user to lift a free weight. The programmed workout can also cause certain indicators to illuminate to assist the user in knowing which free weight to use. In those examples where the free weight assembly is incorporated into another exercise machine (e.g. treadmill, elliptical trainer, stationary bicycle, stepper machine, rowing machine, or another type of exercise machine), the programmed workout can control the parameters of that exercise machine as well. For example, the programmed workout can cause the processor to control the speed of a tread belt; the incline of the treadmill's deck; the side to side tilt of the treadmill's deck; a resistance level of an elliptical trainer, a stationary bicycle, or another type of exercise machine; entertainment on the exercise machine; a volume level; a climate control; a vibration level; a scene depicted in a display; another parameter of the exercise machine; or combinations thereof.

An aerobic exercise instructor incorporated into the exercise device may represent programmed instructions that, when executed, cause the processing resources to control the aerobic portion of the user's workout. The aerobic exercise may include, but is not limited to, walking, running, shuffling, skipping, biking, jumping, or otherwise moving with the tread belt in operation. The aerobic exercise instructor may control the speed and/or incline of the tread belt based on the user's heart rate or other physiological readings, the user's goals, a programmed workout, inputs from the user, or combinations thereof.

An anaerobic exercise instructor incorporated into the exercise device may represent programmed instructions that, when executed, cause the processing resources to control the anaerobic portions of the user's workout. The anaerobic exercise instructor may instruct the user to perform lifts, perform a number of repetitions, perform a type of lift, perform other aspects of the anaerobic portion of the workout, or combinations thereof.

A weight selector incorporated into the exercise device may represent programmed instructions that, when executed, cause the processing resources to select the amount of weight to lift. In one embodiment, the free weights include an adjustable dumbbell, and a selector is incorporated into the free weight assembly. In those examples where the free weights include an adjustable dumbbell, the selector may mechanically adjust the connections between the weight plates and dumbbell's handle so that the desired amount of weight is automatically attached to the dumbbell's handle. In this situation, the user does not have to make manual adjustments to the dumbbell. In other examples, the weight selector indicates to the user which of multiple free weights the user is to lift. In this example, the free weight assembly may include multiple free weights with varying amounts of mass. Each of the potential free weights that could be lifted by the user are associated with a single indicator. To communicate to the user which of the multiple free weights is to be lifted, the programmed workout can cause the indicator associated with the desired free weight to activate. In this case, the user can determine to lift the free weight that is associated with the activated indicator.

The processing resources may determine the time when the user is to perform the lift with the free weight. The processing resources may be in communication with an input of the free weight assembly. The processing resources may send a signal to the input to activate the indicator. The processing resources may send the signal to the input in response to determining that the user has completed a previously assigned portion of the workout. In another example, the signal is sent in response to a predetermined time lapse from when the user was previously assigned to perform an aerobic portion of the workout. In yet another example, the signal is sent to the input in response to a physiological condition. In one of these examples, the programmed workout may instruct the user to run for a certain amount of time within a certain heart rate zone. In this example, after a heart rate monitor communicates to the processing resources that the user's heart rate has been in the target zone for the predetermined amount of time, the signal is sent to activate the indicator.

In some circumstances the processing resources provide instructions to the free weight assembly that the indictors are to be activated under certain conditions. The processor may depend on other instruments to provide the information that the specified conditions are meet. In some cases, an activity tracker worn by the user that tracks the user's age, fitness level, amount of sleep, calorie input, calorie burn, activity level, workout histories, health conditions, and/or other types of information may send information directly to the free weight assembly's input. The information received by from the activity tracker may indicate whether specified conditions are meet and thereby cause the indicator to activate.

In some circumstances, the user can provide an input into the free weight assembly or the exercise device when he or she has completed the assigned lift. In that circumstance, the programmed workout can instruct the user to perform another activity or indicate that the workout is finished. In those circumstances where the workout is to continue, the programmed workout may instruct the user to perform another type of lift, to rest, to perform another set of repetitions of the same lift, to perform an aerobic exercise on the exercise machine, perform another activity, or combinations thereof.

In other cases, the exercise device and/or the exercise machine can determine when the user has finished the lift. In one example, the programmed workout can determine that the lift is finished when the user returns a free weight to the cradle. In another example, the programmed workout can determine when the user has finished the lifts through another type of sensor, such as an optical sensor, a weight scale associated with the exercise device or otherwise networked to the exercise device and/or networked to the free weight assembly. In another example, a magnetic counter may be incorporated into the exercise device and/or the free weight assembly. In this embodiment, a magnet may sense each time the free weights move through an area near the magnetic sensor, which can signal to the programmed workout that another lift has been performed.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, the adjustable dumbbell, a mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

While the examples above have been described with the free weight assembly being incorporated into an exercise machine, such as a treadmill, the free weight assembly may be independent of another exercise device. In one example, the free weight assembly includes a stand, and a cradle incorporated into the stand where the free weights can be located. In this example, the free weights may be an adjustable dumbbell, and the cradle has a selection mechanism that connects and disconnects the weight plates from the dumbbell's handles. The programmed workout that indicates when the time has arrived for the user to pick up the free weights may also cause the selection mechanism to connect and/or disconnect certain weight plates so that the adjustable dumbbell is the correct weight for the intended lift. In other cases, the indicator activates indicating that the adjustable dumbbell is ready for the lift after the selection mechanism has connected and/or disconnected the appropriate weight plates.

Any appropriate type of indicator may be used to communicate to the user to remove the free weight. In some examples, the indicator includes a light that illuminates when the time has arrived for removing the weight. In some cases where the cradle holds multiple free weights of varying amounts, multiple lights may be incorporated into the cradle or into the free weights themselves. When the time has arrived to remove a specific free weight, the light associated with that specific free weigh illuminates indicating to the user to remove that free weight.

In yet another example, the indicator includes a speaker. In this example, the speaker can broadcast audio instructions for the user to remove the weight. In examples where the indicator includes a speaker, the indictor can provide the user with other types of information, like the number of repetitions, the lift type, safety recommendations, pacing information, other types of information associated with the lift or other aspects of the workout, or combinations thereof.

In another example, the indicator may include a display that can present written messages to the user about lifting the weight, the amount of weight to lift, pacing information, safety recommendations, the lift type, or other types of information relating to the lift or other portions of the workout.

In those examples where an adjustable dumbbell is used, the programmed workout may send instruction to the adjustable dumbbell that connects and/or disconnects weight plates to the dumbbell's handle. In one example, the cradle may include selectors that are incorporated into the troughs defined in the cradle. These selectors may be spaced within the cradle so that each of the selectors correspond to each weight plate of the dumbbell's weight set. As the dumbbells are received in the troughs, the selectors protrude into the cavities defined in the weight plates. The linear position of the selectors is adjustable and is controlled based on the programmed workout's instructions. The linear position of the selectors determines whether the weight associated with the selector is connected to the dumbbell or released from the dumbbell.

The selector may include a rod linearly movable to engage a selection mechanism in the adjustable dumbbell through the cavity. A linear actuator may cause the rod to be in a first linear position or a second linear position. In the first linear position, a distal end of the selector engages the connection features causing the connection features to disconnect the weight from the dumbbell's handle.

In the second linear position of the selector, the distal end moves away from the connection features. In this type of situation, the distal end may not inhibit the connection features from moving. The connection features may be spring loaded or otherwise urged into the interlocking position when no opposing force is applied to put the connection features into the release position. Thus, as the distal end moves out of the way, the connection features move back into the interlocking position.

When the adjustable dumbbells are docked in the cradle, the selector can disconnect the corresponding weights by moving the rod into the first linear position. For those weights that are to remain connected to the adjustable dumbbells, the rods can be positioned so that the rods do not cause the connection features to release the weights. Alternatively, the rods may move to release the weights and reconnect them.

The invention claimed is:

1. A stationary exercise machine comprising:

an aerobic exercise element configured to be movable during execution of a programmed workout;

an adjustable dumbbell having an adjustable weight;

a display;

one or more processors; and memory configured to store programmed instructions of the programmed workout that, when executed by the one or more processors, cause the one or more processors to:

automatically alternate, by the programmed instructions of the programmed workout, between aerobic portions of the programmed workout and lifting portions of the programmed workout;

automatically control, by the programmed instructions of the programmed workout, a speed, or a resistance level, of the aerobic exercise element during the aerobic portions of the programmed workout; and automatically adjust the adjustable weight of the adjustable dumbbell;

automatically present, by the programmed instructions of the programmed workout, lifting instructions on the display, the lifting instructions configured to instruct a user on lifting the adjustable dumbbell during the lifting portions of the programmed workout.

2. The stationary exercise machine of claim 1, wherein the lifting instructions further instruct the user on performing a specific exercise with the adjustable dumbbell.

3. The stationary exercise machine of claim 1, wherein the lifting instructions further instruct the user on types of lifts to perform, and a number of repetitions to perform with each of the types of lifts, using the adjustable dumbbell.

4. The stationary exercise machine of claim 1, wherein the lifting instructions further instruct the user on how to perform a lift using the adjustable dumbbell.

5. The stationary exercise machine of claim 1, wherein the lifting instructions further instruct the user on a safety precaution about a lift using the adjustable dumbbell.

6. The stationary exercise machine of claim 1, wherein the lifting instructions further instruct the user on pacing information associated with a lift using the adjustable dumbbell.

7. The stationary exercise machine of claim 1, wherein the lifting instructions further instruct the user to perform negatives using the adjustable dumbbell by lifting up the adjustable dumbbell relatively quickly and lowering down the adjustable dumbbell relatively slowly.

8. The stationary exercise machine of claim 1, wherein the lifting instructions further instruct the user to lift up the adjustable dumbbell and lower down the adjustable dumbbell at a same rate.

9. The stationary exercise machine of claim 1, wherein the lifting instructions include written words and images.

10. The stationary exercise machine of claim 1, wherein:

the stationary exercise machine further comprises an upright portion that has a console that includes the display; and the lifting instructions further instruct the user to lift the adjustable dumbbell in a free weight area in a front end of the stationary exercise machine proximate the upright portion.

11. The stationary exercise machine of claim 1, wherein:

the stationary exercise machine further comprises a speaker; and the speaker is configured to audibly broadcast at least a portion of the lifting instructions.

12. The stationary exercise machine of claim 1, wherein the programmed instructions of the programmed workout, when executed by the one or more processors, further cause the one or more processors to simultaneously:

automatically present, by the programmed instructions of the programmed workout, aerobic instructions on the display during a current one of the aerobic portions of the programmed workout, the aerobic instructions configured to instruct the user about a current aerobic exercise activity during the current one of the aerobic portions of the programmed workout; and automatically present, by the programmed instructions of the programmed workout, lifting instructions on the display for an upcoming one of the lifting portions of the programmed workout.

13. The stationary exercise machine of claim 1, wherein the programmed instructions of the programmed workout, when executed by the one or more processors, further cause the one or more processors to:

automatically present, by the programmed instructions of the programmed workout, warm up instructions on the display, the warm up instructions configured to instruct the user on performing a warm up activity of the programmed workout; and automatically present, by the programmed instructions of the programmed workout, cool down instructions on the display, the cool down instructions configured to instruct the user on performing a cool down activity of the programmed workout.

14. The stationary exercise machine of claim 1, wherein:

the memory further configured to store a library of programmed workouts from which the programmed workout can be selected by the user; and the library of programmed workouts is downloadable to the memory from a remote network location over a Wi-Fi network connection.

15. The stationary exercise machine of claim 1, wherein the one adjustable dumbbell include a cradle connected to the aerobic exercise element.

16. The stationary exercise machine of claim 1, wherein:

the stationary exercise machine comprises a stationary bicycle; and the aerobic exercise element includes pedals.

17. The stationary exercise machine of claim 1, wherein:

the stationary exercise machine comprises a stationary treadmill; and the aerobic exercise element includes a tread belt.

18. A stationary exercise machine comprising:

an aerobic exercise element configured to be movable during execution of a programmed workout;

an upright portion that has a console that includes a display;

one or more processors; and memory configured to store a library of programmed workouts from which the programmed workout can be selected by a user, the memory further configured to have the library of programmed workouts downloaded to the memory from a remote network location over a Wi-Fi network connection, the memory further configured to store programmed instructions of the programmed workout that, when executed by the one or more processors, cause the one or more processors to:

automatically present, by the programmed instructions of the programmed workout, warm up instructions on the display, the warm up instructions configured to instruct the user on performing a warm up activity of the programmed workout;

automatically alternate, by the programmed instructions of the programmed workout, between aerobic portions of the programmed workout and lifting portions of the programmed workout;

automatically control, by the programmed instructions of the programmed workout, a speed, or a resistance level, of the aerobic exercise element during the aerobic portions of the programmed workout;

automatically adjust, by the programmed instructions of the programmed workout, an adjustable weight of an adjustable dumbbell during the lifting portion of the programmed workout;

automatically present, by the programmed instructions of the programmed workout, aerobic instructions on the display, the aerobic instructions configured to instruct the user about aerobic exercise activity during the aerobic portions of the programmed workout;

automatically present, by the programmed instructions of the programmed workout, lifting instructions on the display, the lifting instructions configured to instruct the user on lifting the adjustable dumbbell during the lifting portions of the programmed workout; and automatically present, by the programmed instructions of the programmed workout, cool down instructions on the display, the cool down instructions configured to instruct the user on performing a cool down activity of the programmed workout.

19. The stationary exercise machine of claim 18, wherein:

the stationary exercise machine comprises a stationary bicycle; and the aerobic exercise element includes pedals.

20. The stationary exercise machine of claim 18, wherein:

the stationary exercise machine comprises a stationary treadmill; and the aerobic exercise element includes a tread belt.

* * * * *